United States Patent [19]

Mahnke et al.

[11] Patent Number: 4,793,608

[45] Date of Patent: Dec. 27, 1988

[54] EXERCISE APPARATUS

[75] Inventors: Parker E. Mahnke, Studio City; Ron Sheltra, Alhambra, both of Calif.

[73] Assignee: Marcy Fitness Products, Ontario, Calif.

[21] Appl. No.: 916,639

[22] Filed: Oct. 8, 1986

Related U.S. Application Data

[63] Continuation-in-part of Ser. No. 608,372, May 9, 1984, abandoned.

[51] Int. Cl.[4] ..... A63B 21/06

[52] U.S. Cl. ..... 272/118; 272/134; 272/144

[58] Field of Search ..... 272/118, 117, 134, 144, 272/123, 93, DIG. 4; D21/195, 196

[56] References Cited

U.S. PATENT DOCUMENTS

| | | | |
|---|---|---|---|
| Re. 28,066 | 7/1974 | Marcyan | 272/118 |
| D. 261,021 | 9/1981 | Lambert, Sr. | D21/196 |
| 403,703 | 5/1889 | Small . | |
| 931,699 | 8/1909 | Medart . | |
| 3,207,512 | 9/1965 | Kinsey . | |
| 3,235,255 | 2/1966 | Leflar | 272/81 |
| 3,647,209 | 3/1972 | La Lanne | 272/58 |
| 3,840,227 | 10/1974 | Chesemore | 272/81 |
| 3,912,263 | 10/1975 | Yatso | 272/81 |
| 3,971,555 | 7/1976 | Mahnke | 272/118 |
| 4,019,861 | 3/1912 | Titus . | |
| 4,211,403 | 7/1980 | Coffaro et al. | 272/134 |
| 4,317,566 | 3/1982 | Uyeda et al. | 272/118 |
| 4,339,125 | 7/1982 | Uyeda et al. | 272/118 |
| 4,349,192 | 9/1982 | Lambert, Jr. et al. | 272/118 |
| 4,407,495 | 10/1983 | Wilson | 272/117 |
| 4,456,246 | 6/1984 | Szabo | 272/118 |
| 4,505,475 | 3/1985 | Olschansky et al. | 272/118 |
| 4,538,805 | 9/1985 | Parviainen | 272/118 |

FOREIGN PATENT DOCUMENTS

| | | | |
|---|---|---|---|
| 2659520 | 7/1978 | Fed. Rep. of Germany | 272/134 |
| 82/02667 | 8/1982 | PCT Int'l Appl. | 272/118 |
| 2065482 | 7/1981 | United Kingdom | 272/122 |

OTHER PUBLICATIONS

Travel Bag Publication, 4/1984, p. 50.

*Primary Examiner*—David A. Scherbel
*Assistant Examiner*—Caroline D. Dennison
*Attorney, Agent, or Firm*—James E. Brunton

[57] ABSTRACT

A multipurpose exercise machine for accomplishing progressive resistance exercises. The machine comprises a free-standing frame including a single central guide column providing generally vertical, transversely spaced apart guide channels, a carriage movable upwardly and downwardly along the central guide column, two side by side stacks of weights disposed below the carriage, a pair of selector bars extending between the weights and the carriage; connecting means for connecting a selected number of weights to the selector bars, a body engaging means, such as a handlebar including gripping portions connected to the carriage for pivotal adjustment with respect thereto, a cable system operably interconnecting an overhead arm exercising subassembly and a bench mounted leg and arm exercising subassembly with the weights for use in performing various arm and leg exercises, and a fully adjustable exercise bench connected to the frame to support the trainee during the performance of a variety of different types of exercises using the bench mounted subassembly.

26 Claims, 6 Drawing Sheets

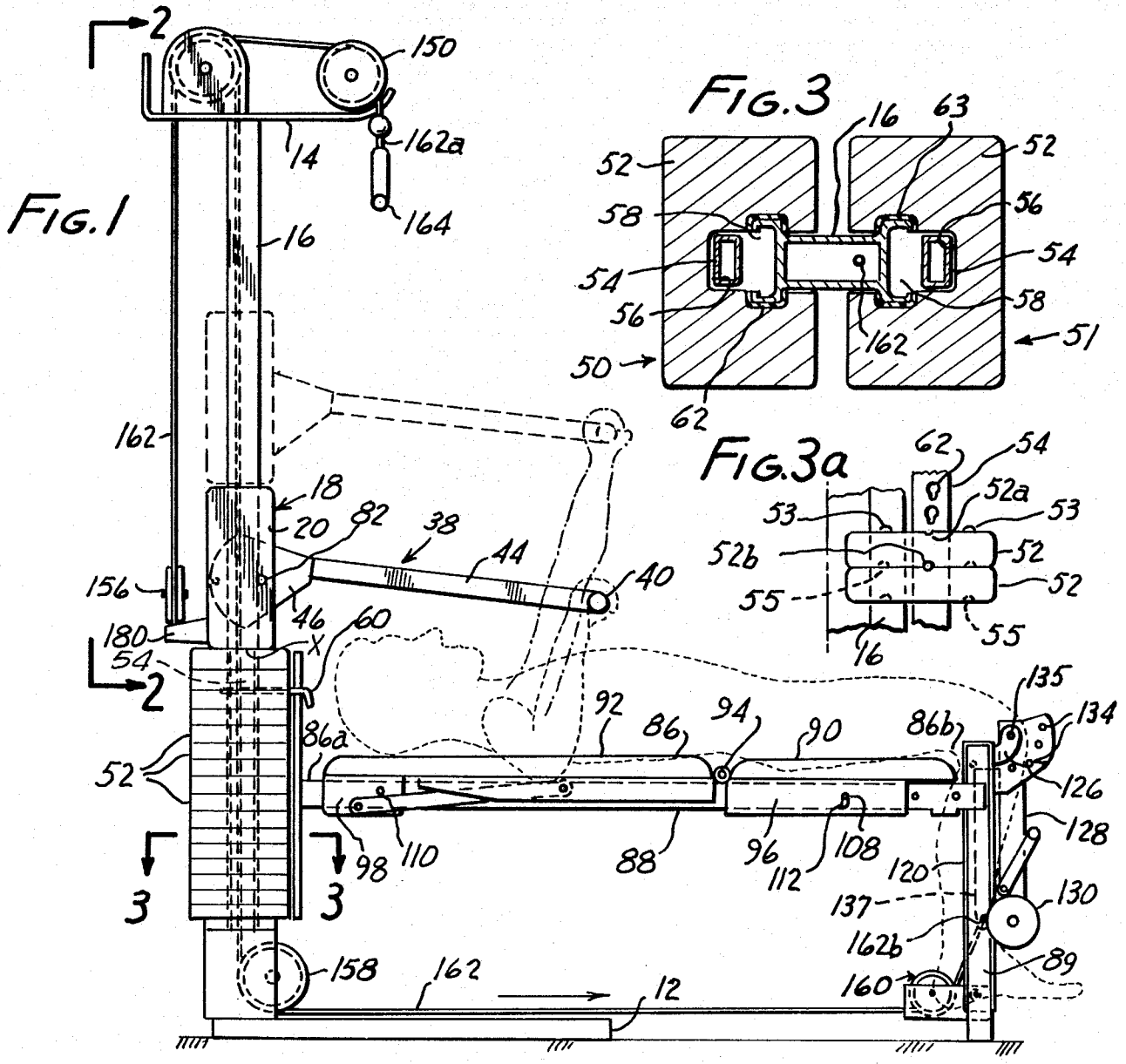
FIG. 3
FIG. 3a
FIG. 1
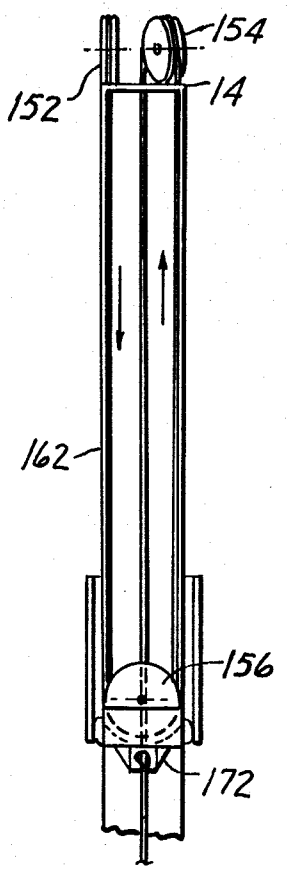
FIG. 2

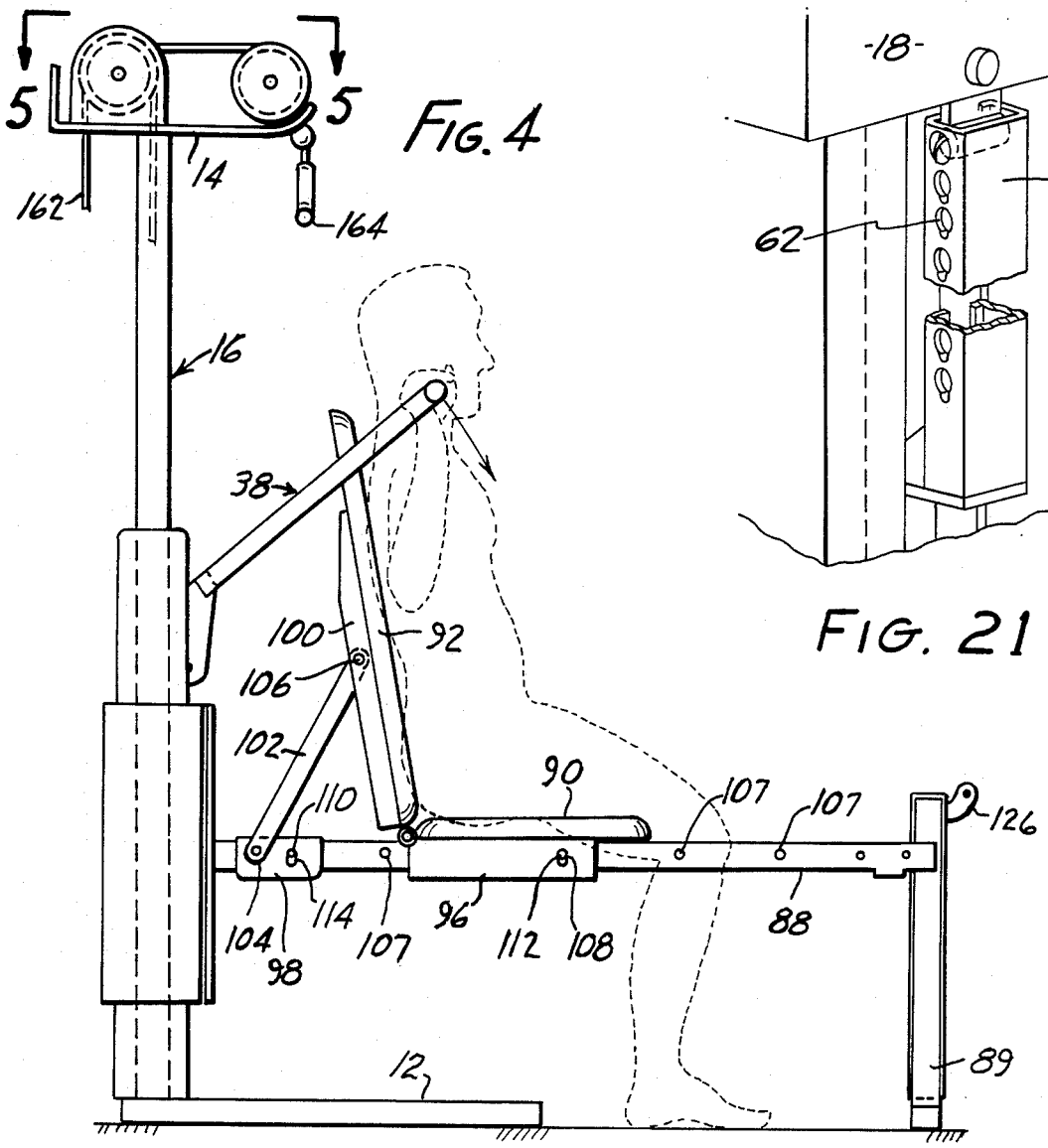
FIG. 4
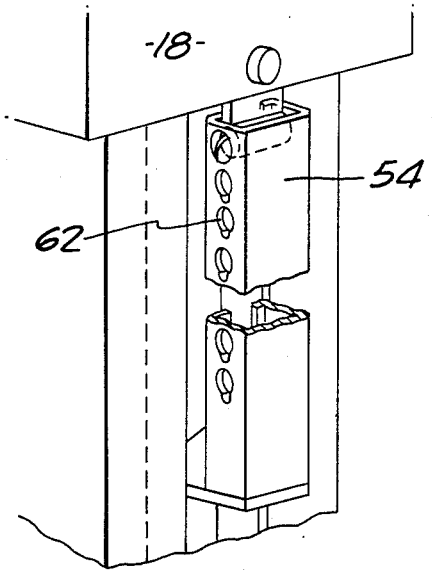
FIG. 21
FIG. 5
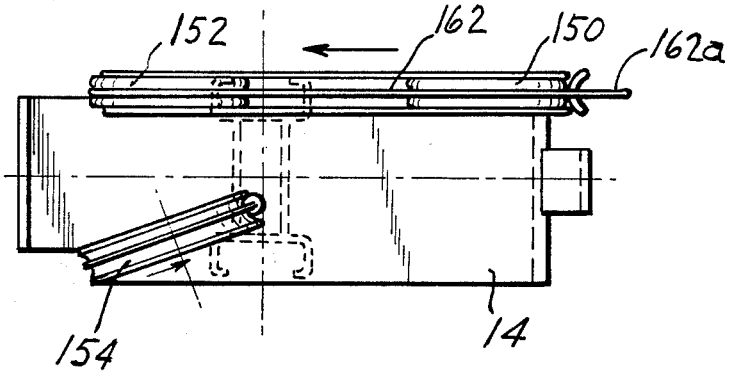

FIG. 10
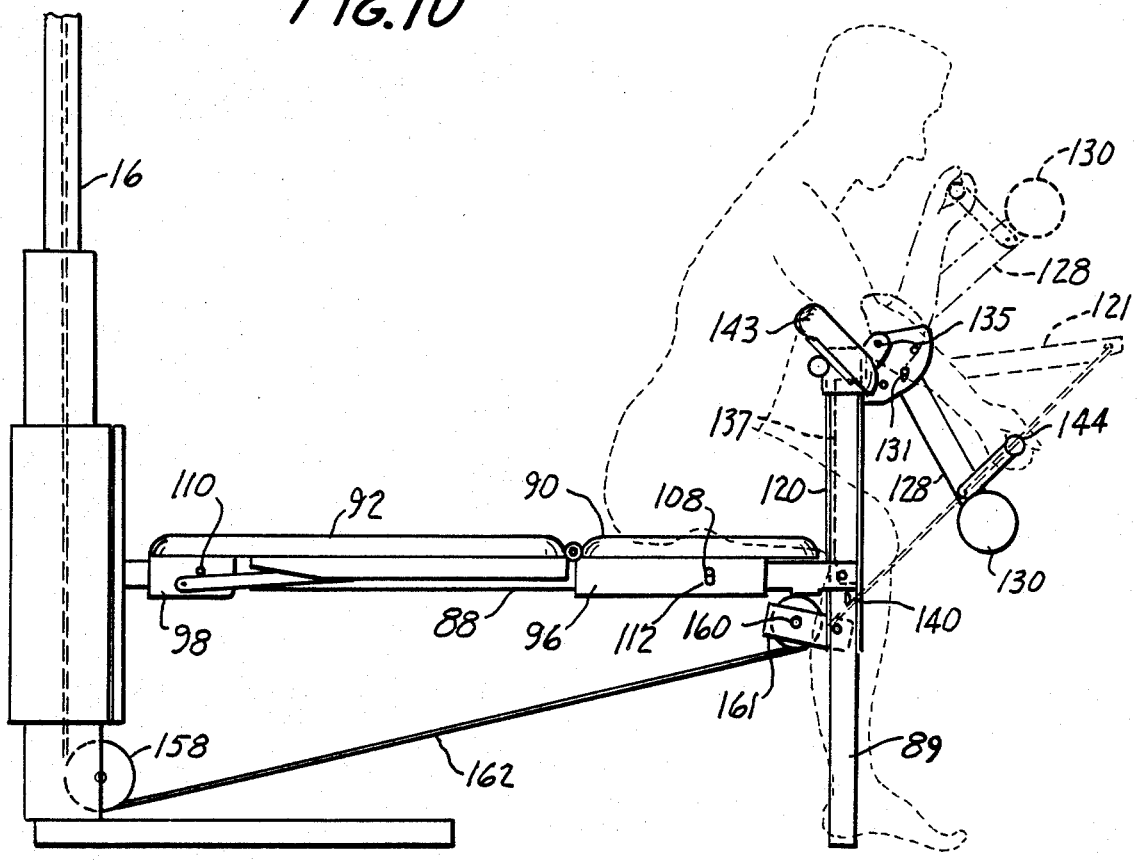
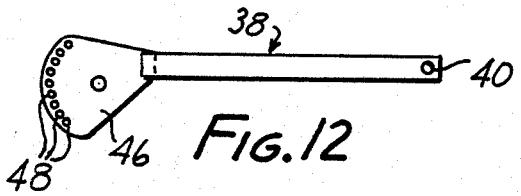
FIG. 12
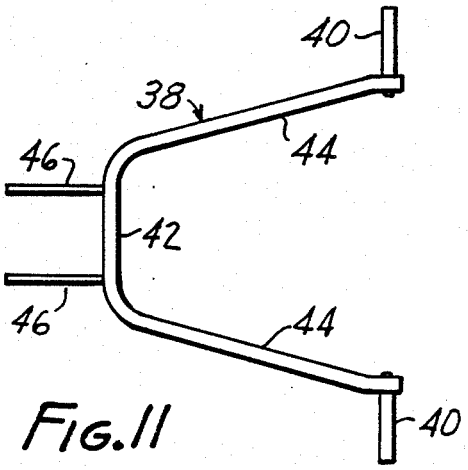
FIG. 11
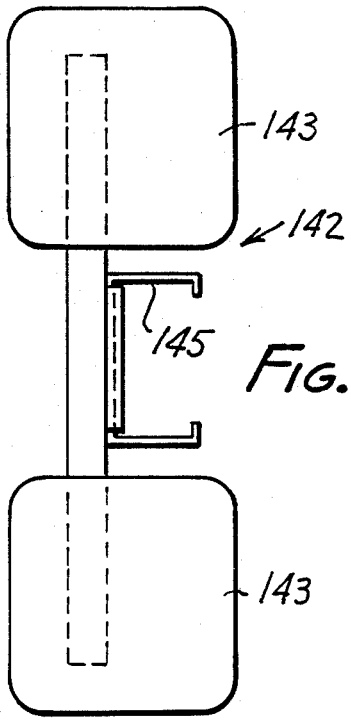
FIG. 13

18
20
82
16
26
28
67
66
72
68
80
22
178
180
24
46
74
70
76
78
30
32
15
17

EXERCISE APPARATUS

This application is a continuation-in-part application of co-pending application Ser. No. 608,372, filed filed May 9, 1984 now abandoned.

BACKGROUND OF THE INVENTION

1. Field of the Invention

The present invention relates generally to a body exercising apparatus and more particularly to a free standing, multipurpose exercise machine for accomplishing progressive resistance exercises.

2. Discussion of the Prior Art

The therapeutic value of progressive resistance exercises has long been recognized. Exercising muscles against progressively increasing weights not only results in added strength and endurance in the muscles, but also in the improvement of neuromuscular coordination and in a more efficient functioning of the cardiovascular and respiratory systems.

Traditionally apparatus such as dumbbells and barbells have been used for progressive exercises. The use of such apparatus, however, can be extremely dangerous when undertaken without proper training and supervision. When a large amount of weight is being lifted, barbells are particularly dangerous and present difficult balancing problems. If they are dropped, serious injury can result to the trainee or to those about him.

In the past, various types of progressive weight training machines have been suggested to over come the drawbacks of barbells and dumbells. Among the most successful of these prior are devices are those described in the U.S. Pat. No. 3,971,555, U.S. Pat. No. Re. 28,066 and in U.S. Pat. No. 4,317,566.

SUMMARY OF THE INVENTION

It is an object of the present invention to provide an improved free-standing progressive resistance exercise apparatus which is simpler, more versatile and easier to use than prior art machines making it ideally suited for use in homes, apartments and offices as well as in gymnasiums.

More particularly, an object of the invention is to provide an exercising machine which includes a main frame comprising a single central guide column providing generally vertical, spaced apart guide channels, a carriage movable upwardly and downwardly along the central guide column, two side by side stacks of weights disposed below the carriage, a pair of selector bars extending between the weights and the carriage; connecting means for connecting a selected number of weights to the selector bars, a body engaging means, such as a handlebar including gripping portions connected to the carriage for pivotal adjustment with respect thereto, a capable system operably connected to the weights for use in performing various arm and leg exercises, and a fully adjustable exercise bench connected to the frame to support the trainee during the performance of a further variety of different types of exercises.

Another object of the invention is to provide a machine of the aforementioned character which includes a novel, easy to operate quick locking and release mechanism for adjusting the height of the gripping portions of the handlebars above the ground by pivotally moving the handlebar relative to the carriage.

Still another object of the invention is to provide a machine of the type described in the preceding paragraphs which embodies a unique interconnection mechanism for releasably interconnecting the cable system with the weight stacks.

A further object of the invention is to provide a machine of the class described in which the bench portion of the device is adjustable into several orientations to permit the trainee to do various types of exercises in a sitting position, in a prone position and in a reclined position.

More particularly there is provided at the outboard end of the bench a novel subassembly which, in a lowered position, can be used for various leg exercises and in a raised position can be used for the performance of arm exercises such as an arm curl. Yet another object of the invention is to provide an apparatus which embodies the aforementioned features and also includes two weight stacks thereby providing greater overall weight capacity while at the same time maintaining the advantages of small weight increments.

Still another object is to provide such a machine which is highly safe and reliable, embodies a minimum number of component parts, is easily adjustable without the use of special tools and is smoother, safer and more positive in operation than similar prior art machines.

The superior engineering design and compactness of the machine of the present invention permits it to be inexpensively manufactured, easily set up and operated in numerous locations, and to be safely used even by unskilled persons with a minimum of training.

BRIEF DESCRIPTION OF THE DRAWINGS

FIG. 1 is a side elevational view of one form of the apparatus of the present invention being used to execute a supine press.

FIG. 2 is a fragmentary view take along lines 2—2 of FIG. 1 illustrating the arrangement of the cable system of the invention which functions to interconnect the weights with the arm and leg exercising subassemblies the apparatus.

FIG. 3 is a view taken along lines 3—3 of FIG. 2 showing the manner in which the central guide column and the connector bars are received within the weights.

FIG. 3*a* is a fragmentary end view of two of the weights disposed in one of the two weight stacks, further illustrating the manner in which the selector bars are received within the weights.

FIG. 4 is a side elevational view of the apparatus embodying the principles of the present invention being used to execute a seated, or incline press.

FIG. 5 is a plan view taken along lines 5—5 of FIG. 4 showing the arrangement of the upper sheaves of the cable system of the invention.

FIG. 10 is a side elevational view of the apparatus embodying the principles of the present invention being used to execute an arm curl type exercise.

FIG. 11 is a plan view of the outwardly extending pivotally adjustable handlebar assembly of one form of the present invention.

FIG. 12 is a side elevational view of the handlebar assembly shown in FIG. 11.

FIG. 13 is a plan view of the arm support pads having been removed from the arm and leg exercising subassembly shown in FIGS. 8, 9 and 10.

FIG. 18 shows one form of the locking means of the invention for locking one of the sheaves of the connector means against upward movement.

DESCRIPTION OF THE INVENTION

Figures 6, 7, 7A, 8, 9:
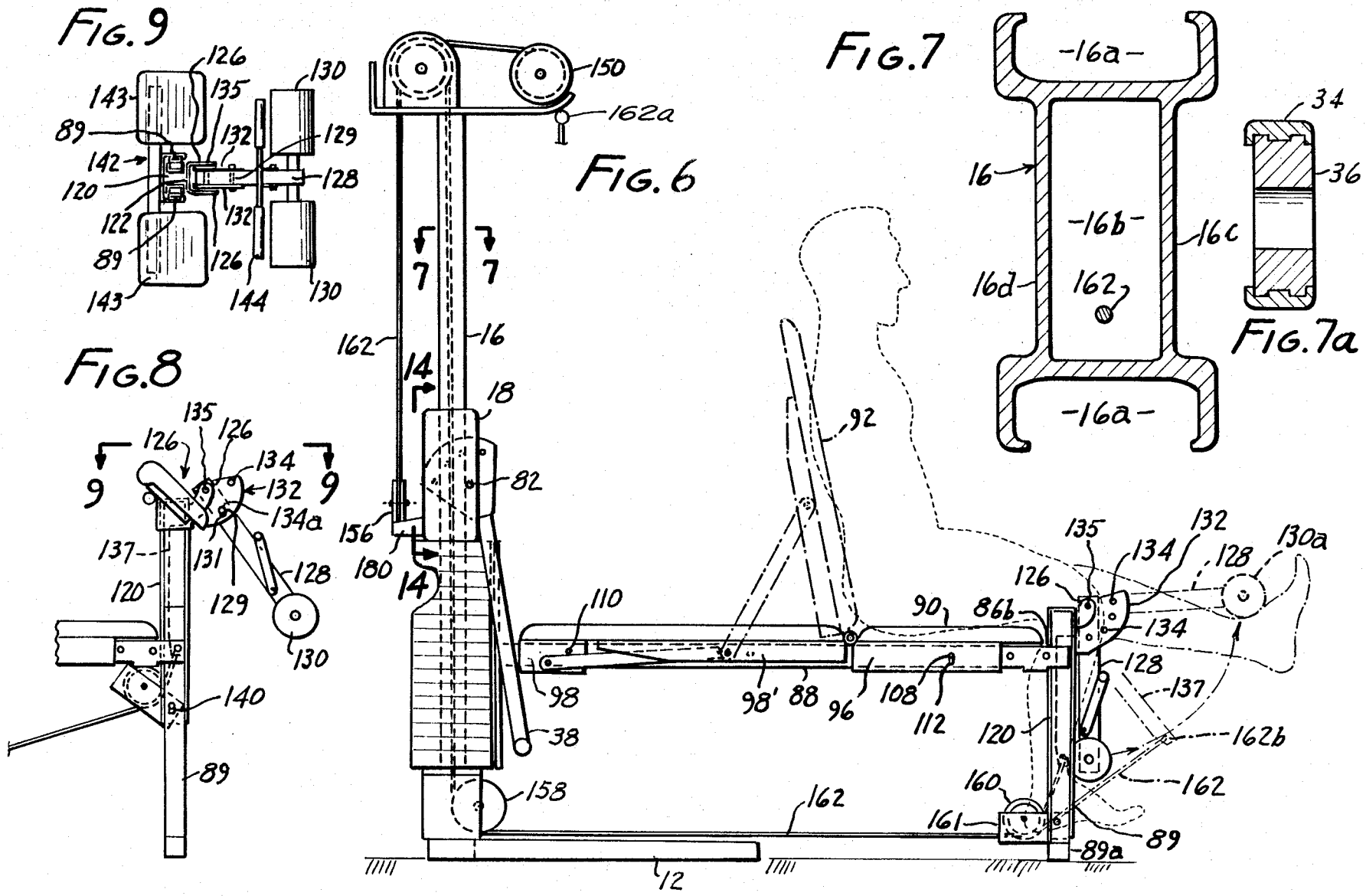
FIG. 6 is a side elevational view of the apparatus of the present invention being used to accomplish leg extension exercises.
FIG. 7 is a cross-sectional view taken along lines 7—7 of FIG. 6 illustrating the unique cross-sectional configuration of the central guide column.
FIG. 7*a* is a cross-sectional view of one of the carriage rollers, which rollers are adapted to roll along the guide channels of the guide column.
FIG. 8 is a fragmentary side elevational view of one of the arm and leg exercising subassemblies of the apparatus shown in an upraised position and including removable arm support pads to enable the use of this subassembly for performing arm curl exercises.
FIG. 9 is a plan view taken along lines 9—9 of FIG. 8 further illustrating the appearance of this exercising subassembly showing in plan the arm support pads which have been added to enable the performance of arm curls.

Referring to the drawings, and particularly to FIGS. 1, 2 and 3, the exercising apparatus of the present invention comprises an upstanding main frame which includes a base 12, a top 14 and a generally vertically extending central guide column 16 disposed intermediate base 12 and top 14. As best seen by referring to FIGS. 3 and 7, the central guide column 16 has a pair of transversely spaced guide channels 16*a* and a central hollow portion 16*b* defined by front and rear planar web members 16*c* and 16*d* which are disposed intermediate guide channels 16*a*. A carriage 18 is adapted for vertical movement upwardly and downwardly along central guide column 16 between a first position and a second higher, or upraised, position.

Figures 14, 15, 16, 17:
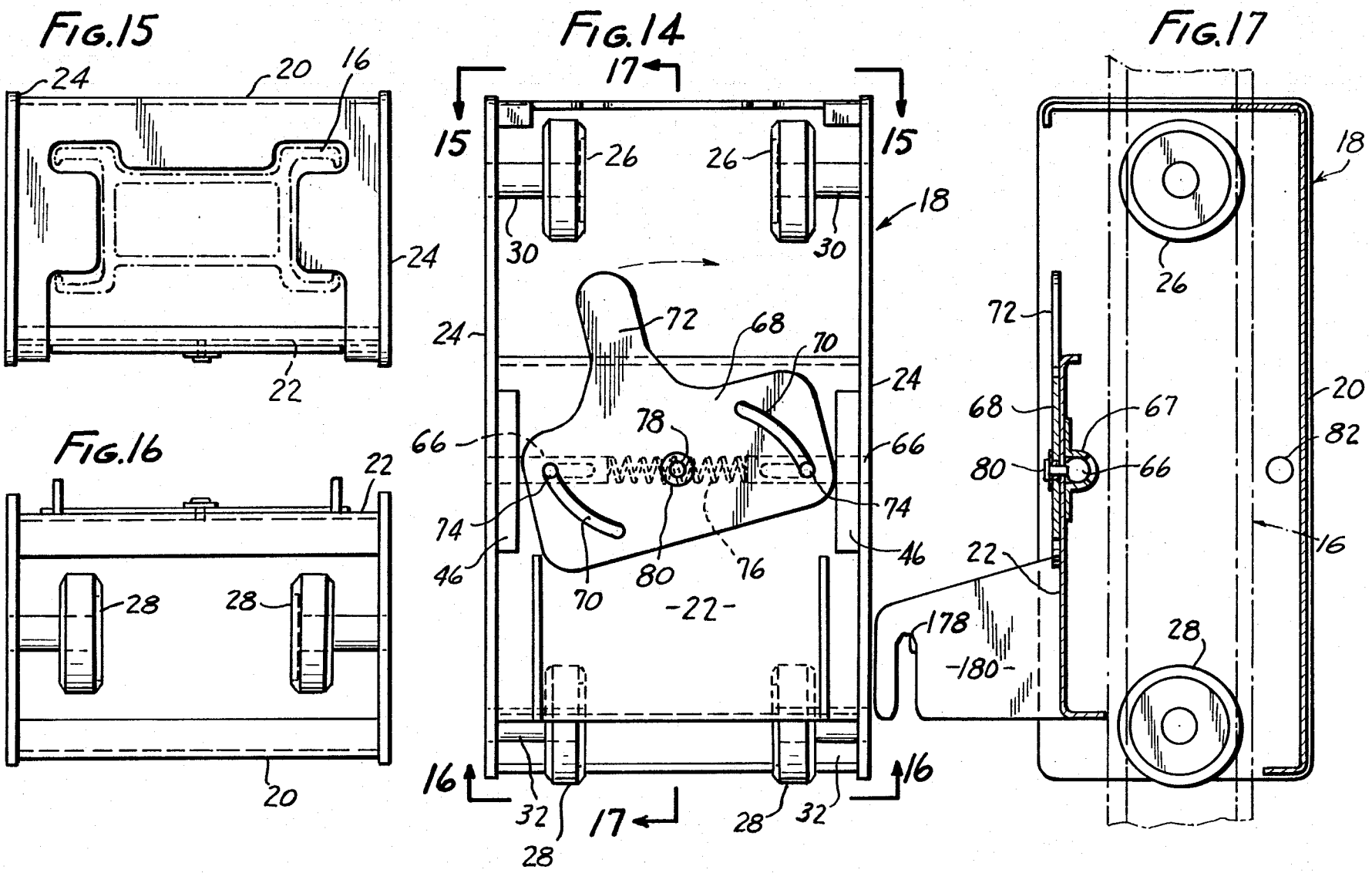
FIG. 14 is a view taken along line 14—14 of FIG. 6 illustrating the carriage configuration and showing one form of the handlebar adjustment mechanism of the invention which is adapted to releasably lock the handlebar in various pivotal positions with respect to the carriage.
FIG. 15 is a view taken along line 15—15 of FIG. 14.
FIG. 16 is a view taken along lines 16—16 of FIG. 14.
FIG. 17 is a cross-sectional view taken along lines 17—17 of FIG. 14 further illustrating the construction of the carriage and of the handlebar adjustment mechanism of the apparatus.

Referring also to FIGS. 14, 15 and 16, carriage 18 is provided with front, back and side portions 20, 22 and 24 respectively. Additionally, carriage 18 is provided with first and second vertically spaced apart bearing, or roller means shown here as upper and lower pairs of wheels 26 and 28 respectively. As best seen by referring to FIG. 14, wheels 26 and 28 are rotatably carried by inwardly extending vertically spaced axles 30 and 32 which are in turn carried by side walls 24 of the carriage. Turning to FIG. 7*a*, each of the wheels 26 and 28 are of identical construction comprising an outer plastic, or hard rubber, tire portion 34, which surrounds a central ball bearing 36, which bearing is adapted to be mounted on axles 30 and 32 so as to permit smooth rotation of the wheel about the axles. It is to be noted that the outer tire portion of the wheel is configured figured so as to be closely received within the specifically shaped channels 16*a* formed in the central guide column, thereby ensuring minimum binding and chatter as the carriage reciprocates along the guide column.

Referring once again to FIG. 1 and to FIGS. 11 and 12, extending outwardly, or forwardly, from the front face 20 of the carriage 18 is first body engaging means for moving the carriage 18 upwardly relative to central column 16. In this embodiment of the invention, the first body engaging means comprises a handlebar-like member 38 which includes spaced apart hand engaging means, or handgrips, 40 adapted for engagement by the trainee, or user, of the apparatus. As illustrated in FIG. 11, handlebar 38 is generally U-shaped in configuration, having a bight portion 42 and angularly outwardly extending portions 44. Extending rearwardly from, and connected to bight portion 42 are transversely spaced apart, generally planar pivot plates or members 46. The spacing of members 46 is such that they will be closely received within the side panels 24 of the carriage 18 (FIG. 14). In a manner presently to be described, the first body engaging means is pivotally connected to carriage 18 and can be locked in a plurality of intermediate positions between a first lowered position and a second elevated position. For this purpose, members 46 are provided with a plurality of spaced apart apertures 48 which lie along an arc of a circle (FIG. 12).

Turning once again to FIGS. 1 and 3, carried on base 12 and disposed proximate either side of central guide column 16 are first and second stacks of weights 50 and 51, each weight stack being made up of a plurality of individual, discrete weights 52. To interconnect carriage 18 with one or more of the weights 52 so as to bias carriage 18 against upward movement, there is provided a pair of spaced apart, generally vertically extending connector columns 54 (FIG. 3). These connector columns, or selector bars, 54 are pivotally connected by any suitable connectors, such as bolts at each side of the base of carriage 18 as for example proximate the location X indicated in FIG. 1 and, in the manner shown in FIGS. 3 and 3*a*, depend downwardly through an aperture 56 formed in each of the weights 52.

As shown in FIG. 3, each of the weights 52 is also provided with an aperture 58 which is configured to closely receive the end guide channel portions of central guide column 16. Referring to FIG. 3*a*, which is an illustrative fragmentary view showing only two of the weights 52 and being broken away to show a portion of one of the selector bars 54, each of the weights 52 includes channels, or grooves, 52*a* and 52*b* formed in the top and bottom of the weight. These channels are semicircular in cross-section so that when the weights are stacked in the manner indicated in FIGS. 1 and 3*a*, the channels 52*a* and 52*b* will align to form a passageway adapted to receive a selector pin 60 (FIG. 1). As shown in FIG. 3*a*, each selector bar 54 is provided with a plurality of vertically spaced keyhole-shaped apertures 62 which are adapted to closely align with the passage ways formed by channels 52*a* and 52*b* in adjoining weights. The selector pin 60 is of such a length that it will extend through the passageways between the weights into the aligned aperture 62 provided in the selector bar 54. When the selector pin 60 is thus in place, the weights above the selector pin will be operably interconnected with the carriage 18 and will move with it as the carriage is moved upwardly along the central guide column 16 by forces exerted upwardly on the handlebar 38. It is to be understood that a selector pin 60 is provided for each weight stack 50 and 51 so that one or more weights from either or both weight stacks can be interconnected with the carriage.

It is important to not that, as the carriage moves upwardly and downwardly, the central guide column not only constrains the path of the carriage, but also guides the vertical travel of the weights 52 which have been interconnected with the carriage. To assist in the smooth upward travel of the weights, guide bushings 63 are provided in the apertures 58 of each of the weights. These guide bushings engage the outer portions of the central central guide column and permit the weights to move smoothly upwardly and downwardly relative to the central guide column. To insure that the weights will be perfectly aligned within each of the identical weight stacks, each weight is provided with a plurality of protuberances 53 on the top of the weight which mate with depressions 55 formed in th* bottom of the weight (FIG. 3*a*).

Forming an important aspect of the apparatus of the invention is a novel, conveniently accessible adjustment means carried by the back face 22 of the carriage 18 for cooperation with the rearwardly extending pivot plate members 46 of the handlebar to position the handlebar at a plurality of intermediate positions between a first lowermost position and a second uppermost position. This adjustment means permits the expeditious vertical adjustment of the body engaging portions of the handlebar relative to the base of the apparatus. Referring particularly to FIGS. 14, 15, 16 and 17, the adjustment means in this embodiment of the invention is provided in the form of a pair of axially aligned locking members 66 which are operably associated with camming means for moving the locking members between a first position, wherein the ends of the members extend into the arcuately spaced apertures 48 of the rearwardly extending plate-like portions 46, to a second retracted position wherein the ends of members 66 are removed from the apertures 48. In the present form of the invention, the camming means comprises a cam plate 68 having spaced apart arcuate grooves, or channels, 70 and an upwardly extending gripping, or arm-like, portion 72. Each of the pins 66 is telescopically movable within a channel defined by a bracket 67 (FIG. 17) affixed to the rear face 22 of the carriage and each pin is provided with a transversely extending cam engaging member 74, which members are closely receivable within cam channels 70. Disposed intermediate members 66 is a biasing means, or spring, 76, which is adapted to resist retraction of the pin 66. With the construction thus described, when the operator exerts a force on the arm 72 of cam plate 68 in the direction of the arrow in FIG. 14, members 74 will tend to follow along channels 70 as the cam plate pivots about a central pivot point 78. As best seen in FIG. 17, pivot point 78 is defined by a fastener 80 which interconnects cam plate 68 with the rear face 22. As the cam plate is rotated, members 74 progressively move members 66 inwardly against the resisting force of spring 76. Upon full rotational movement of cam plate 72, pins 66 will be completely retracted from the apertures 48 formed in the rearwardly extending side plates of the handlebars and the handlebar will be free to pivot about a forwardly disposed pivot axis located proximate the forward face of carriage 18 and defined by a pivot axle 82 (FIG. 1).

So long as the cam plate 68 is maintained in the fully rotated position, the handlebar will be free to move pivotally upwardly and downwardly about axle 82. When the body engaging portions of the handlebar are at the desired height above the floor, the finger 72 of cam plate 68 is released. Spring 76 will then urge locking pins 66 outwardly toward the side plate of the handlebar. Slight movement of the handlebar upwardly or downwardly will then cause the locking pins 66 to align with and extend into adjacent apertures 48 formed in the handlebar side plates 46. With this arrangement, the handlebar can be safely and securely locked in the desired angular position with the body engaging means thereof positioned at a desired height above the base of the apparatus.

Another very important feature of the apparatus of the present invention comprises an elongated user support bench generally designated in FIG. 1 by the numeral 86. Bench 86 has a first end portion **86*a* connected to the free standing frame of the apparatus, and a second forwardly displaced outboard end 86*b*. Bench 86 includes a supporting framework which comprises a generally horizontally extending frame member 88 and transversely spaced, downwardly extending legs 89. Frame member 88 defines a substantially horizontally extending upper support surface adapted to carry a user engaging means, or platform, comprising pivotally interconnected seat and back assemblages 90 and 92 respectively. Seat and back assemblages 90 and 92 are pivotally interconnected by a hinge means 94 and each includes a slide member 96 and 98 adapted to slide along frame member 88** of the bench.

As best seen in FIG. 4, back support assemblage 92 includes a support member 100 which is pivotally interconnected with slide member 98 by means of a brace 102. Brace 102 is pivotally connected to slide member 98 by a pivot pin 104 and is pivotally connected to support member 100 by a pivot pin 106. In order to lock slide members 96 and 98 in selected positions along frame member 88, the frame member is provided with a plurality of horizontally spaced apertures 107 adapted to selectively align with apertures 108 and 110 formed in slide members 96 and 98 respectively. Removable locking pins 112 and 114 are removably receivable within apertures 108 and 110 and apertures 109 formed in frame member 88. When pins 112 and 114 are in place as illustrated in FIG. 1, slide members 96 and 98 are locked against sliding movement relative to frame member 88. However, removal of pin 112 will permit slide member 96 to slide inwardly of the apparatus in the manner illustrated in FIG. 4. Similarly, removal of pin 114 will permit slide member 98 to slide outwardly, or forwardly, of the apparatus toward end portion **86*b* in the manner illustrated in the phantom lines of FIG. 6. Stated another way, this novel construction permits seat 90 to be moved with respect to the bench frame from a first position, such as is illustrated in FIG. 1, to a second position, such as is illustrated in FIG. 4. Similarly, back portion 92 is movable relative to the bench frame from the first substantially horizontal position shown in FIG. 1, to several inclined positions, one of which is shown in FIG. 4. It is also to be noted that because of the position of slide 96 and 98, the entire seat and back assembly can uniquely be slidably forwardly and rearwardly with respect to the bench frame member 88**.

Focusing now on FIG. 4, with the seat and assemblages positioned in the manner illustrated, the trainee can comfortably and safely accomplish seated and inclined press exercises. It should be observed that because of the ability of the seat and back assemblages to slide along the bench framework, the back support 86 can be conveniently moved to a position intermediate the body engaging portions of the handlebar 38 thereby permitting the trainee to safely and comfortably perform the seated and inclined press exercises.

Still another important aspect of the exercising apparatus of the present invention, comprises second body engaging means mounted proximate the second end portion 86*b* of the bench for permitting the performance of the various types of arm and leg exercises. Referring particularly to FIGS. 6, 8 and 9, the second body engaging means of this embodiment of the invention includes generally vertically extending leg members 120 which are telescopically movable with respect to leg 89 of bench 86. Affixed proximate the upper end of leg 120 is a yoke-like bracket 122 having forwardly extending transversely spaced ear portions 126 (FIG. 8). Pivotally connected to bracket 122 is a second member 128, having at its free end a pair of transversely spaced apart body engaging means or pads 130 (FIG. 9). Disposed intermediate the inside walls of ears 126 and the side surfaces of member 128 is a pair of forwardly extending curved, plate-like members 132, which are provided with a plurality of arcuately spaced apertures 134. Rigidly connected to members 132 and movable therewith is a downwardly depending leg 137. With the construction illustrated in the drawings, member 132, along with leg 137 which is connected thereto, and member 128 are free to pivot about the connector 135 (FIG. 9), which extends through the ears 126 and forms a pivot axis. More particularly member 128 is free to pivot from a first position shown in the solid lines in FIG. 6 to a second raised position shown by the phantom lines in FIG. 10.

As best seen in FIGS. 8 and 9, member 128 is apertured at 129 in a manner such that it is progressively pivoted about connector 135, aperture 129 will become sequentially aligned with each of the arcuately spaced apertures 134 formed in forwardly extending plates 132. By inserting a locking pin 131 through the apertures designated 134*a* in FIG. 8, member 128 can be locked in the raised intermediate position shown in FIG. 8. In similar fashion, member 128 can be locked against downward movement in other intermediate starting height positions defined by the locations of apertures 134 formed in plates 132. However, because plates 132, along with leg 137, are free to pivot upwardly along with member 128, arm curl and other types of arm exercises can readily to performed with the parts free to move upwardly in the manner indicated by the phantom lines in FIG. 10. It is this unique starting height adjustability feature which permits the second body engaging means to be used for the performance of numerous types of arm and leg exercises.

When the second body engaging means is in the lowered position shown in FIG. 6 and the trainee is resting on the seat and back in the manner shown, the body engaging pads 130 can be comfortably interengaged by the feet of the user. A straightening of the legs in the manner indicated in the phantom lines in FIG. 6 will cause the body engaging means 130 to move arcuately upwardly to the position indicated in FIG. 6 by the numeral 130a. As will presently be described, the apparatus of the invention also includes connector means for releasably interconnecting the second body engaging means with the weights to cause to weights to bias against the upward pivotal movement of the body engaging portions 130.

Turning once again to FIGS. 8, 9 and 10, a highly novel feature of the invention resides in the ability to convert the second body engaging means from a leg exercising apparatus of the character shown in FIG. 6 to an arm curl exercising apparatus of the character shown in FIG. 10. This is accomplished by moving members 120 telescopically upwardly with respect to members 89 and locking them in the upward position by means of a suitable locking clamp or by a pin 140 (FIG. 8) which is adapted to extend through aligned apertures formed in members 89 and 120. As will be discussed further hereinafter, when members 120 are telescoped upwardly, the pulley assembly which is pivotally connected to members 120 also moves upward with members 120 in the manner shown in FIGS. 8 and 10.

To enable the second body engaging means to be used for performing arm curl exercises, an arm support pad assembly of the character illustrated in FIG. 13 and identified by the numeral 142 is slidably inserted over member 120 to assume the position illustrated in FIGS. 8 and 9. With the arm support pads 142 thusly in position, the trainee can rest his arms on the upper transversely spaced portions 143 as shown in FIG. 10 and grip transversely extending, hand engaging, or gripping means 144, which are pivotally connected to, and extend outwardly from, member 128. With the second body engaging means in the position illustrated in FIG. 10, the upward bending, or "curling", of the trainee's arms will cause further arcuate upward movement of bar 128 and member 137 about the pivot point defined by connector 135. Because gripping means 144 are pivotally connected to member 128, the gripping means will automatically accommodate trainees having differing arm lengths. As previously mentioned, the connector means, which means will now be described, functions to bias against upward pivotal movement of member 128 during the performance of the arm curl exercises.

Referring to FIGS. 1, 2 and 5, the connector means of the present form of the invention comprise first, second and third sheaves 150, 152 and 154 respectively, which are rotatably mounted on the top 14 of the upstanding frame of the apparatus. Turning particularly to FIGS. 1 and 2, the connector means can be seen to further comprise a fourth sheave 156 which is normally disposed proximate the rear surface of the central guide column 16 and intermediate base 12 and top 14 of the upstanding frame. Sheave 156 is normally free to move upwardly and downwardly but, in a manner presently to be described, can be locked in place in the position shown in FIG. 1.

The connector means of the present embodiment of the invention also comprises a fifth sheave 158 which is rotatably mounted on the main frame proximate base 12 (FIG. 1) and a sixth sheave 160 which is rotatably carried at the second end of the bench 86 by members 120 between legs 89. As previously discussed sheave 160 is both rotatably and pivotally carried by members 120 for movement from the first lowered position shown in FIG. 6 to the second raised position shown in FIG. 10. An elongated cable 162, which also comprises a part of the connector means, has a first upper end 162*a* (FIG. 1) and a second lower end 162*b* (FIG. 6). The first end of cable 162 is connected to a third body engaging means shown here in the form of a downwardly depending handlebar, or gripping member, 164 (FIG. 1). The second end 162*b* of the cable is connected with member 137 of the second body engaging means, the construction of which has already been described. It is to be noted that when the second body engaging means is in the configuration shown in FIG. 6, sheave 160 and its supporting bracket is locked against pivotal movement by cross member 89*a* which is affixed to legs 89. However, when the apparatus is in the configuration shown in FIG. 10, the sheave 160 and its supporting bracket are free to pivot in the manner illustrated. This pivotal movement automatically accommodates the change in cable length required to adjust the members 120 from the lower leg exercising position to the upper arm exercising position.

Starting with its first end 162*a*, the path of the cable can be described as follows: First the cable is entrained over first and second sheaves 150 and 152 in the manner shown in FIG. 5. It then extends downwardly to the rear of guide column 16 under and around fourth sheave 156 in the manner shown in FIGS. 1 and 2. Next cable 162 then extends upwardly over and around sheave 154 and thence downwardly through the hollow central portion 16*b* of guide column 16 (see FIGS. 2 and 5). Proximate the base of the apparatus the cable is entrained under fifth sheave 158 and thence extends substantially horizontally under and around sixth sheave 160. After passing under sheave 160, the second end of the cable is operably connected with member 137 of the second body engaging means in the manner shown in FIG. 6.

With the construction thus described, a downward force exerted on the gripping member 164 will tend to foreshorten the cable causing sheave 156 to move upwardly relative to base 12. Because sheave 156 is operably interconnected with carriage 18 in a manner presently to be described, upward movement of sheave 156 will also result in upward movement of the carriage 18 along with any weights which are connected thereto by means of the selector bars. Such interconnection biases against downward movement of the gripping member 164. Similarly, if a force is exerted on the second body engaging means, tending to move members 128 and 137 pivotally upwardly, the cable 162 will tend to be foreshortened, once again causing sheave 156 to move upwardly carrying with it the carriage 18 and any weights which may be connected thereto. With this unique arrangement, exercises may be performed which involve pulling downwardly on gripping member 164 or, in the alternative, causing upward pivotal movement of member 128 of the second body engaging means either as a result of movement of the legs in the manner shown in FIG. 6 or by "curling" of the arms in the manner shown in FIG. 10.

Figure 18:
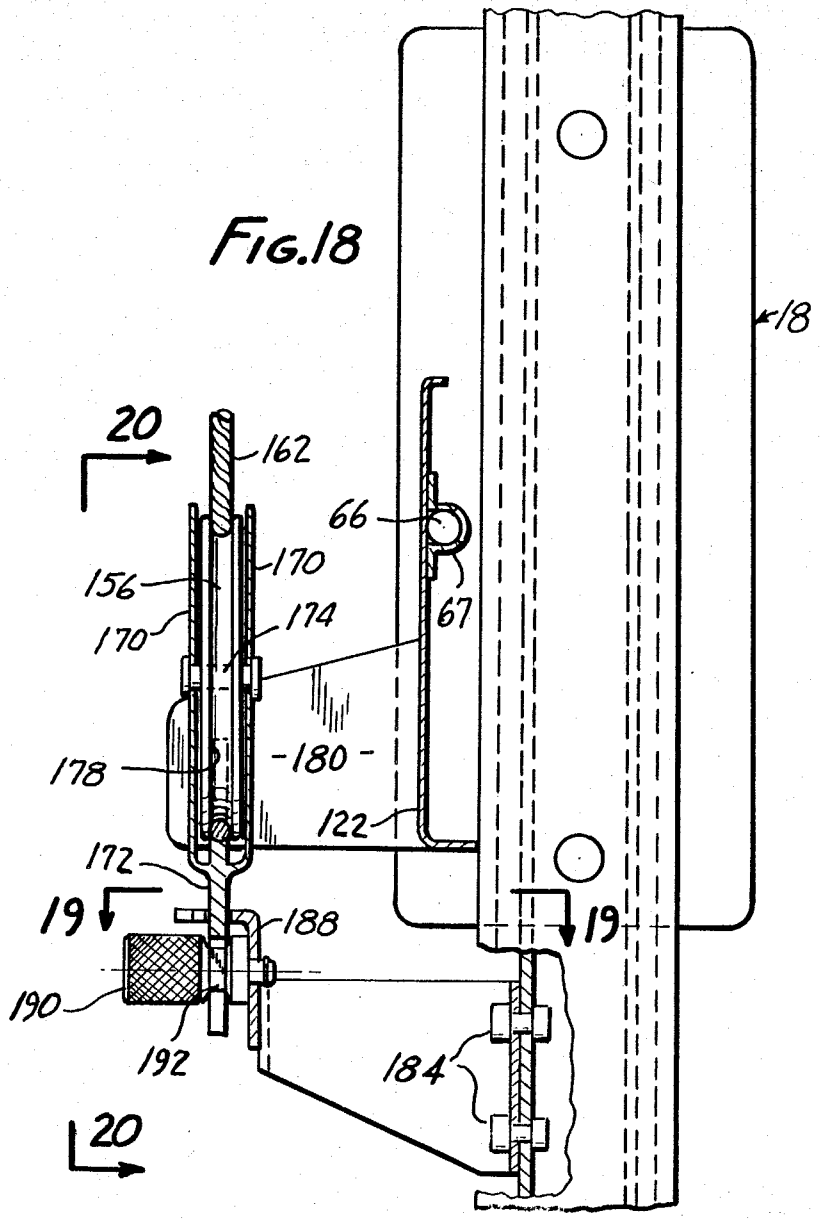
FIG. 18 is an enlarged fragmentary side elevational view of the central portion of the apparatus illustrating a portion of the connector means which functions to interconnect one or more of the weights with the various exercising subassemblies of the device. More particularly
Figure 19:
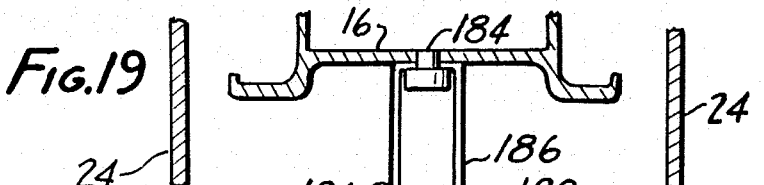
FIG. 19 is a cross-sectional view taken along lines 19—19 of FIG. 18.
Figure 20:
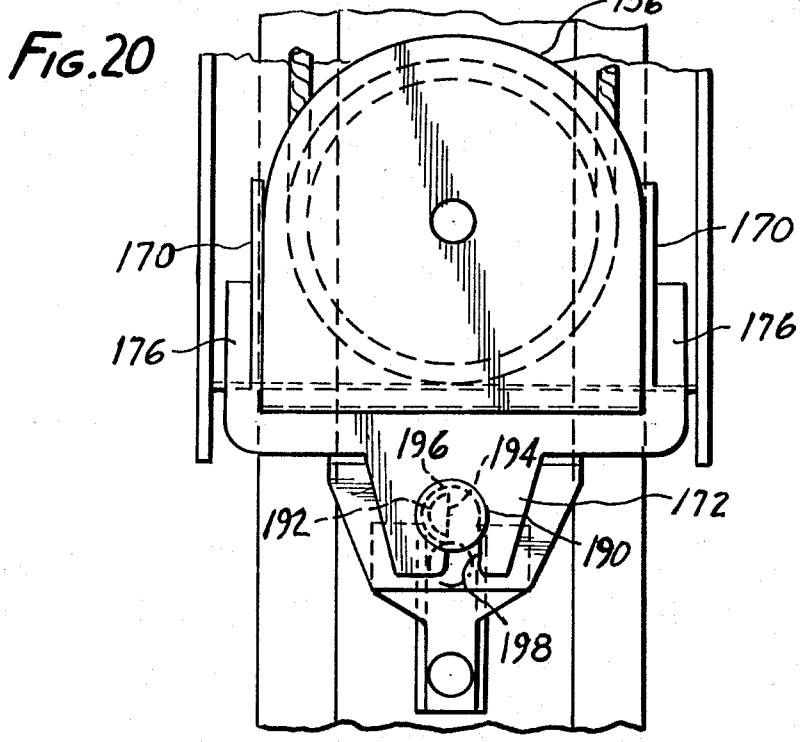
FIG. 20 is a fragmentary view taken along lines 20—20 of FIG. 18.

Still another unique feature of the apparatus of the present invention comprises sheave locking means for locking fourth sheave 156 against upward movement due to forces exerted on the first or second ends of cable 162. Referring to FIGS. 18, 19 and 20, sheave 156 is carried for rotation within a yoke-like subassembly having generally vertically extending, planar side walls 170 which are interconnected at their lower ends by a downwardly depending tongue-like member 172 (FIG. 18). Side members 170 carry an axle 174 about which sheave 156 rotates and also are provided with transversely spaced apart wing-like side portions 176 which are adapted to be closely received within slots 178 formed in a pair of rearwardly extending planar members 180 which members are affixed to the rear face of carriage 18 (FIGS. 17 and 18).

Turning now particularly to FIG. 19, a rearwardly extending interlocking assembly, generally designated by the numeral 182 is rigidly connected to the central portion of guide column 16 by means of a pair of spaced apart fasteners 184 (FIG. 18). Assembly 182 comprises a pair of spaced apart, rearwardly extending side members 186 carrying, at their rearward extremities, an angle bracket 188. Angle bracket 188 is slotted at 189 (FIG. 19) to closely receive the downwardly depending tongue 172 of the sheave carrying yoke which carries sheave 156. Rotatably affixed to, and extending rearwardly from, angle bracket 188 is a locking knob 190. Locking knob 190 is uniquely formed having a shank portion 192 which is formed with a flat 194 (FIG. 20) which extends across the entire diameter of shank 192. As best seen by referring to FIG. 20, tongue 172 is provided with a circular aperture 196 which is interconnected with the lower edge of tongue 172 by means of a slot 198 which is of a width slightly greater than one-half the diameter of shank 192 of locking knob 190. With this construction, when the component parts are in the position shown in FIG. 20, and knob 190 is rotated so that the flat 194 is in the position shown in FIG. 20, sheave 156 and its mounting yoke will be locked against upward movement by the locking assembly 182 which is rigidly affixed to central guide column 16. However, by rotating knob 190 one hundred and eighty degrees, the flat 194 will assume a position in alignment with the downwardly depending slot 198 formed in tongue 172 permitting sheave 156 in its housing to move upwardly with the shank of the locking knob passing through the slot 198 in tongue 172.

It is apparent that when the sheave 156 and its housing are free to move upwardly relative to locking assembly 182, arm and leg exercises can be performed using the first and second body engaging means. Since the wing-like side portions 176 of the sheave housing are interconnected with the carriage by means of rearwardly extending plates 180 (FIG. 20), upward movement of the sheave assembly will carry along carriage 18 and any weights which are connected thereto via the selector bars. Conversely, when the sheave assembly 156 is locked against upward movement by locking knob 190, neither end of cable 162 will be movable because sheave 156 will be locked against upward movement. However, even though sheave 156 may be locked against upward movement, carriage 18 will nevertheless be free to reciprocate up and down along central guide column 16 with the rearwardly extending plates 180 sliding freely upwardly with respect to wing portions 176 of the sheave assembly.

It is to be observed that when the carriage is in an at rest position sheave assembly 156 is automatically aligned with the rearwardly extending plates 180 for smooth and simple engagement and disengagement of the cable, or pulley system, of the apparatus. Such simple operation and unique storage of the cable system is not found in any apparatus within the prior art.

OPERATION

In operating the apparatus of the invention to, for example, perform a supine press as illustrated in FIG. 1, the trainee first pivotally adjusts the body engaging means relative to the carriage so that the handlebar grips are positioned at the correct vertical starting height for the exercise to be performed. This is done by exerting a force on the upstanding portion 72 of the cam plate 68 in the direction indicated by the arrow in FIG. 14. This causes the cam slots 70 to engage the cam pins 74 in a manner to urge the locking pins 66 inwardly against the urging of spring 76. With the locking pins thus retracted, the handlebar can be freely pivotally moved upwardly or downwardly about axle 82 to the desired position. Release of the cam plate will then cause spring 76 to urge the locking pins 66 outwardly into the adjacent apparatus formed in the pivot plates 46 of the handlebar assembly.

Next, the trainee inserts selector pins into the proper apertures in a given weight in one or both of the weight stacks to interconnect the desired number of weights with the connector column or bars. By exerting upward pressure on the handles, the trainee raises the carriage, the connector bars and the weights located above the selector pins. This lifting force tends to apply and eccentric force to the carriage. However, due to the design of the bearing or roller means of the carriage and the cooperating guide means of the central guide column, this tendency is effectively overcome so that the carriage travels in substantially a vertically straight line.

It is important to observe that as the carriage moves upwardly and downwardly, the central guide column not only constrains the path of travel of the carriage, but also of the weights. The unique configuration of the device minimizes the number of component part required and ensures safe, smooth, positive, reliable and trouble free operation.

When it is desired to perform the seated and inclined press as illustrated in FIG. 4, the pin 112 disposed proximate the second end of bench 86 is removed. Upon raising the back portion of the bench to the inclined position shown in FIG. 4, the slide member 96 of the seat assembly 90 will be caused to slide along bench frame member 88 to the inboard location shown in FIG. 4. Slide member 98 will, of course, be maintained in its locked position by the inboard locking pin 98. With the seat and back in the position shown in FIG. 4, locking pin 112 is then reinserted into aperture 108 in slide member 96 and urged inwardly into an aligned aperture 107 formed in bench frame member. This locks the seat against sliding movement and the trainee can then pivotally adjust the handlebar assembly in the manner previously described, seat himself on the seat, and safely perform the seated or incline press exercise. It is to be observed that due to the unique sliding design of the pivotally interconnected seat and back assemblies of the apparatus, the back can be inclined to an optimum angle and positioned so as to extend between the body engaging portions of the handlebar in the manner illustrated in FIG. 4. This enables the trainee to comfortable grip the body engaging portions of the handlebar and to perform the seated press in a comfortable, stable and safe manner.

When it is desired to perform the arm or leg exercises illustrated in FIGS. 6 and 10 of the drawings, locking pin 112 is left in place, thereby locking slide member 96 against sliding movement and forward locking pin 114 is removed. With this arrangement, when back assembly 92 is pivotally raised to the position shown in FIG. 6, slide member 98 will slide forwardly toward the second end of the bench into the position indicated by the numeral 98'. Pin 114 can then be reinserted into aperture 101 and an aligned aperture 107 provided in frame member 88 so as to lock the assemblage in the position shown in FIG. 6.

With the seat assembly in the forward position the user can then perform arm curl exercises in the manner shown in FIG. 10. To perform these exercises member 120 are telescopically moved upwardly and locked in position by pin 140. As previously mentioned, sheave 160f and its supporting bracket will move upwardly with members 120 and will pivot in the manner shown to accommodate the change in cable length. The arm rest 142 is then affixed by sliding the "U" shaped member 145 (FIG. 13) over member 120 to position it with the arm pads 143 into the location shown in FIGS. 8 and 9. Next, arm 128 is pivoted upwardly and, using pin 131, is locked in an angularly downwardly depending position shown in FIG. 10. The cable or pulley system is then made operable by turning knob 190 so as to release sheave assembly 156 in the manner previously described. The user then seats himself on seat 90 and grips engaging grips 144 in the manner illustrated in FIG. 10 and lifts up on the grips moving member 128 against the biasing of the carriage and the weights connected thereto via member 137 to the approximate position shown by the phantom lines in FIG. 10. Note that the handlebar assembly 38 has been pivoted out of the way to its downwardmost position.

Due to the versatility of the apparatus and the numerous modes of adjustment heretofore described, it is apparent that a wide variety of other types of exercises can be performed.

The invention and its attendant advantages will be understood from the foregoing description and it will be apparent that various changes may be made in the form, construction and arrangement of the parts of the invention without departing from the spirit and scope thereof or sacrificing its material advantages, the arrangement hereinbefore described being merely by way of example. We do not wish to be restricted to the specific form shown or uses mentioned except as defined by the accompanying claims, wherein various portions have been separated for clarity of reading and not for emphasis.

We claim:

1. An exercising apparatus, comprising:

(a) a main frame including a base and a single, generally vertically extending central guide column having guide means;

(b) a carriage vertically movable upwardly and downwardly along said central guide column between a first position and a second higher position, said carriage having bearing means movable along said guide means:

(c) two weight stacks carried by said base substantially below said carriage and disposed proximate either side of said central guide column, each said weight stack comprising a plurality of discrete weights, each said weight having an aperture therethrough comprising a first portion and a second portion, said first portion being adapted to receive a portion of said guide column;

(d) two substantially vertically extending selector bars connected to said carriage and adapted to removably interconnect said carriage with one or more weights from either or both weight stacks, for biasing said carriage downwardly, one of said selector bars being receivable within said second portion of said weight;

(e) a handle bar extending outwardly from said carriage and including spaced apart body engaging means for engagement by a user, said handle bar including at least one pivot plate having a plurality of spaced apart apertures disposed along an arc, said handlebar and pivot plate being adapted for pivotal movement about a transverse axis between a first position and a second position whereby the height of said body engaging means can be adjusted relative to said base of said frame; and (f) adjustment means carried by said carriage at a spaced apart location from said transverse axis for cooperation with said pivot plate of said handlebar to position said handlebar at a plurality of intermediate positions between said first and second positions.

2. An exercise apparatus as defined in claim 1 in which said frame includes a top plate and in which said exercise apparatus further comprises:

(a) supplemental body engaging means for engagement by the user, including a downwardly depending gripping member normally disposed proximate said top plate; and (b) a cable means for interconnecting said supplemental body engaging means with at least one of said weights to bias said gripping member of said supplemental body engaging means against downward movement.

3. An exercising apparatus, comprising:

(a) a vertically reciprocative carriage, having a front face, a rear face and vertically extending parallel side portions and including first and second pairs of vertically spaced apart rollers;

(b) an upstanding frame comprising a base, a top and a single substantially vertically disposed central guide column disposed intermediate said top and said base and having transversely spaced apart first and second guide channels for guiding vertical travel of said rollers;

(c) first body engaging means projecting from said front face of said carriage for moving said carriage upwardly relative to said central guide column;

(d) first and second weight stacks each comprising a plurality of discrete weights disposed proximate either side of said guide column substantially directly below said carriage, each of said weights having an aperture therethrough comprising first and second portions said first portions being adapted to receive a portion of, said guide column;

(e) first and second transversely spaced, substantially vertically disposed connecting columns connected to said carriage and adapted to be connected to at least one of said weights from either or both weight stacks whereby said carriage is biased in a vertically downward direction, said connecting columns being closely receivable in said second portions of said apertures formed in said weights.

4. An exercising apparatus as defined in claim 3 in which said first body engaging means includes a handle bar having transversely spaced apart, rearwardly extending pivot plates disposed proximate said side portions of said carriage for pivotal movement about a transverse axis located proximate one of said faces of said carriage between a first position and a second position whereby the height of said body engaging means can be adjusted relative to said base of said frame, said apparatus further including adjustment means carried by the other of said faces of said carriage for cooperation with said rearwardly extending pivot plates of said handlebar to position said handlebar at a plurality of intermediate positions between said first and second position.

5. An exercising apparatus as defined in claim 3 including:

(a) an elongated user support bench having first and second end portions, said first end portion being connected to said frame;

(b) second body engaging means mounted on said bench proximate said second end portion thereof for engagement by the arms and legs of the user when the user is positioned on said support bench to move said second body engaging means from a first position to a second position; and (c) connector means for releasably interconnecting said second body engaging means with said weights to cause said weights to bias against movement of said second body engaging means from a first position to a second position, said connector means comprising pulley means carried proximate said top and said base of said frame and a cable entrained over said pulley means and extending internally of said central guide column.

6. An exercising apparatus as defined in claim 5 including third body engaging means mounted proximate said top of said frame for downward movement by the user of the apparatus, said third body engaging means being operably interconnected with said weights by said connector means whereby said third body engaging means is biased against downward movement.

7. An exercising apparatus as defined in claim 6 in which said connector means comprises:

(a) first, second and third sheaves rotatably mounted on said top of said frame;

(b) a fourth sheave normally disposed proximate said guide column at a location intermediate said top and said base of said frame;

(c) fifth sheave rotatably mounted on said upstanding frame proximate said base;

(d) a sixth sheave mounted on said support bench proximate second end thereof; and (e) an elongated cable having first and second ends, said first end being operably connected to said third body engaging means, said cable being entrained over said first and second sheaves, then extending downwardly under and around said fourth sheave, then extending upwardly over and around said third sheave, then downwardly through said central guide column under said fifth sheave and then extending substantially horizontally under and around said sixth sheave, said second end of said cable being operably connected to said second body engaging means.

8. An exercising apparatus as defined in claim 7 including sheave locking means for locking said fourth sheave against upward movement due to forces exerted on said ends of said cable.

9. An exercising apparatus as defined in claim 8 in which said sixth sheave is vertically movable from a first position to a second elevated position.

10. An exercising apparatus, comprising:

(a) a vertically reciprocate carriage, including first and second vertically spaced apart roller means;

(b) a frame comprising a base and a substantially vertically disposed central guide column supported at one end by said base and having transversely spaced apart first and second guide means for accepting therewithin and fo guiding vertical travel of said first and second roller means of said carriage;

(c) first body engaging means projecting from said carriage for moving said carriage upwardly relative to said central guide column;

(d) two stacks of weights disposed substantially directly below said carriage, each of said weights having an aperture therethrough comprising first and second portions said first portions being adapted to receive said portion of said guide column within which said first and second roller means are accepted;

(e) two substantially vertically disposed connecting columns connected to said carriage and adapted to be selectively connected to at least one of said weights from either or both stacks whereby said carriage is biased in a vertically downward direction, said connecting column being closely receivable in said second portions of said aperture formed in said weights;

(f) an elongated user support bench having first and second end portions, said first end portion being disposed proximate said frame;

(g) second body engaging means mounted proximate said second end portion of said bench, said means including a pivotally movable portion adapted to be engageable by the user to impart upward pivotal movement thereto;

(h) connector means for releasably interconnecting said second body engaging means with said weights to cause said weights to bias against upward pivotal movement of said pivotally movable portion, said connector means comprising pulley means, including an upwardly movable sheave operably associated with said carriage upon upward movement thereof and a cable entrained around said sheave; and (i) sheave locking means carried by said frame for locking said sheave against upward movement due to forces exerted on said cable from operational engagement of first body engaging means.

11. An exercising device as defined in claim 10 in which said second body engagement means is disposed in a first position below said bench for engagement by the legs of the user.

12. An exercising device as defined in claim 11 in which said second body engaging means is movable from said first position to a second upraised position for engagement by the hands of the user.

13. An exercising device as defined in claim 12 in which said connector means further comprises a pivoting pulley means pivotally connected to said support bench proximate said second end portion said pivoting pulley means being movable from a first lowered position to a second elevated position.

14. An exercising apparatus, comprising:

(a) a vertically reciprocative carriage, having a front face, a rear face and spaced apart side portions and including first and second vertically spaced apart roller means;

(b) a frame comprising a base and a substantially vertically disposed guide column supported at one end by said base and having transversely spaced apart first and second guide channels for accepting therewithin and for guiding vertical travel of said first and second roller means of said carriage;

(c) first body engaging means comprising a handle bar having a pair of transversely spaced apart, rearwardly extending pivot plates each having a plurality of spaced apart apertures, said pivot plates being disposed proximate said side faces of said carriage for pivotal movement about a transverse axis located proximate said front face of said carriage between a first position and a second position whereby the height of said first body engaging means can be adjusted relative to said base of said frame;

(d) adjustment means carried by said rear face of said carriage for cooperation with said rearwardly extending pivot plates of said handlebar to position said handlebar at a plurality of intermediate positions between said first and second positions; said adjustment means comprising:

(i) a locking member;

(ii) camming means associated with said locking member for movement thereof between a first position wherein said locking member simultaneously extends into a selected pair of said spaced apart apertures in each of said pivot plates to a second position wherein said locking member is retracted from said apertures;

(e) a plurality of weights disposed in two stacks substantially directly below said carriage, each of said weights being apertured to receive portions of said guide channels of said guide column; and (f) two substantially vertically disposed connecting columns connected to said carriage and adapted to be selectively connected to at least one of said weights from either or both stacks whereby said carriage is biased in a vertically downward direction.

15. An exercising apparatus as defined in claim 14 in which said adjustment means further comprises biasing means for biasing said locking member toward said first position.

16. An exercising apparatus for the performance of exercises by a trainee, comprising:

(a) a vertically reciprocative carriage, including roller means;

(b) a frame comprising a substantially vertically disposed guide column having guide means for guiding vertical travel of said roller means of said carriage;

(c) first body engaging means projecting from said carriage for engagement by the trainee to move said carriage upwardly relative to said guide column;

(d) a plurality of weights disposed in two stacks;

(e) two connecting columns for interconnection of said carriage with at least one of said weights from either or both stacks whereby said carriage is biased in a vertically downward direction;

(f) bench means disposed in proximate said frame for supporting the trainee;

(g) second body engaging means carried by said bench and being movable from a first lower position to a second higher position;

(h) means for interconnecting said second body engaging means with at least one of said weights including a bench mounted pulley and a cable entrained about said pulley, said pulley being movable from a first lower position to a second elevated position and being pivotally mounted on said support bench, whereby a change in cable length resulting from movement of said bench mounted pulley from said first lower position to said second elevated position is automatically accommodated.

17. An exercising apparatus, comprising:

(a) a vertically reciprocative carriage, including first and second vertically spaced apart roller means;

(b) a frame comprising a substantially vertically disposed guide column having transversely spaced apart first and second guide means for guiding vertical travel of said first and second roller means of said carriage;

(c) first body engaging means projecting from said carriage for moving said carriage upwardly relative to said guide column;

(d) a plurality of weights disposed in two stacks substantially directly below said carriage, each of said weights having an aperture therethrough comprising first and second portions, said first portion being adapted to receive a portion of said guide column;

(e) two substantially vertically disposed connecting columns to said carriage and adapted to be selectively connected to at least one of said weights from either or both stacks whereby said carriage is biased in a vertically downward direction, said connecting column being closely receivable in said second portions of the aperture formed in said weights;

(f) an elongated user support bench having first and second end portions, said first end portion being disposed proximate said frame;

(g) second body engaging means mounted proximate said second end portion of said bench, said means being movable from a first lower position to a second elevated position and including a pivotally movable portion adapted to be engageable by the user to impart upward pivotal movement thereto; and (h) connector means for releasably interconnecting said second body engaging means with said weights to cause said weights to bias against movement of said second body engaging means from a first position to a second position, said connector means comprising a bench mounted pulley mounted on said support bench proximate said second end portion, said bench mounted pulley being movable from a first lower position to a second elevated position and pulley means carried proximate said frame and a cable entrained around said bench mounted pulley and said pulley means and extending internally of said central guide column, said pulley means being pivotally mounted on said support bench, whereby the change in cable length resulting from movement of said bench mounted pulley from said first lower position to said second elevated position can automatically be accommodated.

18. An exercising apparatus for the performance of exercises by a trainee, comprising:

(a) a vertically reciprocative carriage, including roller means;

(b) a frame comprising a substantially vertically disposed guide column having guide means for guiding vertical travel of said roller means of said carriage;

(c) first body engaging means projecting from said carriage for engagement by the trainee to move said carriage upwardly relative to said guide column;

(d) a plurality of weights;

(e) at least one connecting column for interconnection of said carriage with at least one of said weights whereby said carriage is biased in a vertically downward direction;

(f) second body engaging means for operational engagement by the trainee to perform exercises;

(g) third body engaging means for operational engagement by the trainee to perform exercises;

(h) a rotatably sheave disposed proximate said carriage;

(i) a continuous loop cable operably interconnecting said second and third body engaging means and said sheave whereby operational engagement of either said second or third body engaging means by the trainee to perform exercises will cause upward movement of said sheave;

(j) means for automatically interconnecting said carriage and said sheave upon operational engagement of either said second or third body engaging means by the trainee to perform exercises; and (i) means for locking said sheave against automatic interconnection with said carriage upon operational engagement of said first body engaging means by the trainee to perform exercises.

19. An exercising apparatus, comprising:

(a) a main frame including a base and a generally vertically extending guide column having transversely spaced guide channels;

(b) a carriage vertically movable upwardly and downwardly along said guide column between a first position and a second higher position, said carriage having transversely spaced bearing means movable along said guide channels of said guide column;

(c) two weight stacks carried by said base substantially below said carriage and disposed proximate either side of said guide column, each said weight stack comprising a plurality of discrete weights, each said weight having an aperture therethrough comprising first and second portions said first portions being adapted to receive a portion of said guide column;

(d) two substantially vertically extending selector bars connected to said carriage and adapted to removably interconnect said weight with said carriage, for biasing said carriage downwardly, said selector bars being receivable within said second portions of said apertures in said weight stacks; and (e) body engaging means for engagement by a user, said body engaging means being adjustable whereby the height thereof can be varied relative to the base of said main frame.

20. An exercising apparatus, comprising:

(a) a main frame including a base and a generally vertically extending central guide column having guide means;

(b) a carriage vertically movable upwardly and downwardly along said central guide column between a first bearing means movable along said guide means:

(c) two weight stacks carried by said base substantially below said carriage and disposed proximate either side of said central guide column, each said weight stack comprising a plurality of discrete weights, each said weight having an aperture therethrough comprising first and second portions, said first portions being adapted to receive a portion of said guide column;

(d) two substantially vertically extending selector bars connected to said carriage and adapted to removably interconnect said carriage with at least one weight from either or both weight stacks, for biasing said carriage downwardly, said selector bars being receivable within said second portions of said aperture in each said weight;

(e) a handle bar extending outwardly from said carriage and including spaced apart first body engaging means for engagement by a user;

(f) an elongated user support bench having first and second end portions, said first end portion being disposed proximate said frame;

(g) second body engaging means mounted proximate said second end portion of said bench, said means being vertically adjustable and including a pivotally movable portion adapted to be engageable by the user to impart upward pivotal movement thereto; and (h) connector means for releasably interconnecting said second body engaging means with said weights to cause said weights to bias against upward pivotal movement of said pivotally movable portion.

21. An exercising apparatus for the performance of exercises by a trainee, comprising:

(a) a vertically reciprocative carriage, including roller means;

(b) a frame comprising a base and a substantially vertically disposed guide column having guide means for guiding vertical travel of said roller means of said carriage;

(c) a handle bar extending outwardly from said carriage, including first body engaging means for engagement by the trainee to move said carriage upwardly relative to said guide column, said handle bar further including at least one pivot plate having a plurality of spaced apart apertures said handlebar and pivot plate being adapted for pivotal movement about a transverse axis between a first position and a second position whereby the height of said body engaging means can be adjusted relative to said base of said frame;

(d) adjustment means carried by said carriage at a spaced apart location from said transverse axis for cooperation with said pivot plate of said handlebar to position said handlebar at a plurality of intermediate positions between said first and second positions;

(e) a plurality of weights disposed in two stacks;

(f) two connecting columns for interconnection of said carriage with at least one of said weights from either or both stacks whereby said carriage is biased in a vertically downward direction;

(g) bench means disposed proximate said frame for supporting the trainee;

(h) second body engaging means carried by said bench and being moveable from a first lower position to a second higher position and being pivotally adjustable into at least two starting positions;

(i) third body engaging means carried by said frame for downward movement by the user of the apparatus; and (j) connector means for interconnecting said second and third body engaging means with said weights.

22. An exercising apparatus, comprising:

(a) a vertically reciprocative carriage including first and second pairs of vertically spaced apart rollers;

(b) an upstanding frame comprising a base, a top and a substantially vertically disposed central guide column disposed intermediate said top and said base and having transversely spaced apart first and second guide channels for accepting therewithin and for guiding vertical travel of said rollers;

(c) first body engaging means projecting from said front face of said carriage for moving said carriage upwardly relative to said central guide column;

(d) first and second weight stacks each comprising a plurality of discrete weights disposed proximate either side of said guide column substantially directly below said carriage, each of said weights having an aperture therethrough comprising first and second portions, said first portions being adapted to receive a portion of said guide column;

(e) first and second transversely spaced, substantially vertically disposed connecting columns connected to said carriage and adapted to be connected to at least one of said weights from either or both weight stacks whereby said carriage is biased in a vertically downward direction, said connecting columns being closely receivable in said second portions of said apertures formed in said weights;

(f) an elongated user support bench having first and second end portions, said first end portion being disposed proximate said frame;

(g) second body engaging means mounted proximate said second end portions of said bench, said means including a pivotally movable portion adapted to be engageable by the user to impart upward pivotal movement thereto; and (h) connector means for releasably interconnecting said second body engaging means with said weights.

23. An exercising apparatus, comprising:

(a) a vertically reciprocative carriage, including first and second vertically spaced apart roller means;

(b) a frame comprising a base and a substantially vertically disposed central guide column supported at one end by said base and having transversely spaced apart first and second guide means for accepting therewithin and for guiding vertical travel of said first and second roller means of said carriage;

(c) a handlebar including first body engaging means, said handlebar projecting from said carriage for moving said carriage upwardly relative to said central guide column, said handlebar being adjustable whereby the height of said first body engaging means can be adjusted relative to said base of said frame;

(d) a plurality two stacks of weights disposed substantially directly below said carriage, each of said weights having an aperture therethrough comprising first and second portions said first portions being adapted to receive said portion of said guide column within which said first and second roller means are accepted;

(e) two substantially vertically disposed connecting columns connected to said carriage and adapted to be selectively connected to at least one of said weights from either or both stacks whereby said carriage is biased in a vertically downward direction, said connecting column being closely receivable in said second portions of said aperture formed in said weights;

(f) an elongated user support bench having first and second end portions, said first end portion being disposed proximate said frame;

(g) second body engaging means mounted proximate said second end portion of said bench, said means including a pivotally movable portion adapted to be engageable by the user to impart upward pivotal movement thereto; and (h) connector means for releasably interconnecting said second body engaging means with said weights to cause said weights to bias against upward pivotal movement of said pivotally movable portion.

24. An exercising apparatus as defined in claim 23 in which said connector means comprising pulley means, including at least one upwardly movable sheave operably associated with said carriage upon upward movement thereof and a cable entrained around said sheave.

25. An exercising apparatus for the performance of exercises by a trainee, comprising:

(a) a vertically reciprocative carriage, including roller means;

(b) a frame comprising a substantially vertically disposed guide column having guide means for guiding vertical travel of said roller means of said carriage;

(c) first body engaging means projecting from said carriage for engagement by the trainee to move said carriage upwardly relative to said guide column;

(d) a plurality of weights;

(e) at least one of connecting column for interconnection of said carriage with at least one of said weights whereby said carriage is biased in a vertically downward direction;

(f) second body engaging means for operational engagement by the trainee to perform exercises;

(g) third body engaging means for operational engagement by the trainee to perform exercises;

(h) rotatable sheave disposed proximate said carriage, said sheave being biased downwardly;

(i) a cable operably interconnecting said second and third body engaging means and said sheave whereby operational engagement of either said second or third body engaging means by the trainee to perform exercises will cause upward movement of said sheave;

(j) means for automatically interconnecting said carriage and said sheave upon operational engagement of either said second or third body engaging means by the trainee to perform exercises;

(k) means for locking said sheave against automatic interconnection with said carriage upon operational engagement of said first body engaging means by the trainee to perform exercises.

26. An exercising apparatus for the performance of exercises by a trainee, comprising:

(a) a vertically reciprocative carriage, including bearing means;

(b) a frame comprising a base and a substantially vertically disposed guide column having guide means for guiding vertical travel of said bearing means of said carriage;

(c) a handle bar extending outwardly from said carriage, including first body engaging means for engagement by the trainee to move said carriage upwardly relative to said guide column, said handle bar being adjustable whereby the height of said body engaging means can be adjusted relative to said base of said frame;

(d) adjustment means carried by said carriage at a spaced apart location from said transverse axis for cooperation with said pivot plate of said handlebar to position said handlebar at a plurality of intermediate positions between said first and second positions.

(e) a plurality of weights disposed in two stacks;

(f) two connecting columns for interconnection of said carriage with at least one of said weights from either or both stacks whereby said carriage is biased in a vertically downward direction;

(g) bench means disposed proximate said frame for supporting the trainee;

(h) second body engaging means carried by said bench and being movable from a first lower position to a second higher position and being pivotally adjustable into at least two starting positions;

(i) third body engaging means for operational engagement by the trainee to perform exercises;

(j) connector means for interconnecting said second and third body engaging means with said weights.

* * * * *